US007416621B2

(12) United States Patent
Knott

(10) Patent No.: US 7,416,621 B2
(45) Date of Patent: Aug. 26, 2008

(54) LASER ROUNDING AND FLATTENING OF CYLINDRICAL PARTS

(75) Inventor: Henry James Knott, Ypsilanti, MI (US)

(73) Assignee: GKN Sinter Metals, Inc., Romulus, MI (US)

( * ) Notice: Subject to any disclaimer, the term of this patent is extended or adjusted under 35 U.S.C. 154(b) by 531 days.

(21) Appl. No.: 11/188,158

(22) Filed: Jul. 22, 2005

(65) Prior Publication Data

US 2007/0017608 A1 Jan. 25, 2007

(51) Int. Cl.
*C21D 8/00* (2006.01)
*C22D 9/40* (2006.01)

(52) U.S. Cl. ..... 148/565; 148/589; 148/639; 148/645

(58) Field of Classification Search ..... 148/565, 148/639, 645

See application file for complete search history.

(56) References Cited

U.S. PATENT DOCUMENTS

| | | | |
|---|---|---|---|
| 2,428,825 | A | 10/1947 | Arnoldy |
| 3,650,846 | A | 3/1972 | Holland et al. |
| 3,850,698 | A | 11/1974 | Mallozzi et al. |
| 4,151,014 | A | 4/1979 | Charschan et al. |
| 4,226,111 | A | 10/1980 | Wahli |
| 4,401,477 | A | 8/1983 | Clauer et al. |
| 4,414,038 | A | 11/1983 | Dausinger et al. |
| 4,416,130 | A | 11/1983 | Judge, Jr. |
| 4,533,400 | A | 8/1985 | Benedict |
| 4,758,533 | A | 7/1988 | Magee et al. |
| 5,001,917 | A | 3/1991 | Berstein |
| 5,131,957 | A | 7/1992 | Epstein et al. |
| 5,235,838 | A | 8/1993 | Berstein |
| 5,333,480 | A | 8/1994 | Berstein |

(Continued)

FOREIGN PATENT DOCUMENTS

DE 933208 9/1955

(Continued)

OTHER PUBLICATIONS

PCT Search Report for PCT/US2006/027842.

(Continued)

*Primary Examiner*—George Wyszomierski
(74) *Attorney, Agent, or Firm*—Quarles & Brady, LLP

(57) ABSTRACT

A method is disclosed for rounding and/or flattening an annular part that is out of round and/or not flat due to non-uniform internal stresses. The part is first checked for out of round and/or out of flat conditions. Out of round parts are then rounded by introducing compressive stresses into selected surface sections of the part whereby the introduced compressive stresses cause deformation of the annular part thereby rounding the annular part. Alternatively, out of round parts are rounded by relieving compressive stresses in selected surface sections of the part whereby the relieving of compressive stresses causes deformation of the annular part thereby rounding the annular part. Out of flat parts are flattened by introducing compressive stresses into selected surface sections of the part whereby the introduced compressive stresses cause deformation of the annular part thereby flattening the annular part. Alternatively, out of flat parts are rounded by relieving compressive stresses in selected end surface sections of the part whereby the relieving of compressive stresses causes deformation of the annular part thereby flattening the annular part.

28 Claims, 3 Drawing Sheets

U.S. PATENT DOCUMENTS

| | | | | |
|---|---|---|---|---|
| 5,522,706 | A * | 6/1996 | Mannava et al. | 416/215 |
| 5,531,570 | A | 7/1996 | Mannava et al. | |
| 5,879,480 | A | 3/1999 | Hetzner | |
| 5,885,522 | A | 3/1999 | Giannini et al. | |
| 6,009,980 | A * | 1/2000 | Hester | 188/18 R |
| 6,073,337 | A * | 6/2000 | Strom | 29/603.12 |
| 6,203,633 | B1 | 3/2001 | Clauer et al. | |
| 6,335,506 | B2 * | 1/2002 | Christmas et al. | 219/121.66 |
| 6,379,479 | B1 | 4/2002 | Ohbayashi et al. | |
| 6,570,126 | B2 | 5/2003 | Suh et al. | |
| 6,657,160 | B2 | 12/2003 | Hackel et al. | |
| 6,670,578 | B2 | 12/2003 | Hackel | |
| 6,732,699 | B2 | 5/2004 | Wakade et al. | |
| 2002/0033558 | A1 | 3/2002 | Fahey et al. | |

FOREIGN PATENT DOCUMENTS

| | | |
|---|---|---|
| EP | 0 299 111 | 1/1989 |
| FR | 2396088 | 1/1979 |
| GB | 1211664 | 11/1970 |
| GB | 2005167 | 4/1979 |
| JP | 61-108425 | 5/1986 |
| JP | 63-37370 | 2/1988 |

OTHER PUBLICATIONS

English Language Abstract for JP 61-108425.
English Language Translation for DE 933208.
English Language Abstract for FR 2396088.

* cited by examiner

LASER ROUNDING AND FLATTENING OF CYLINDRICAL PARTS

CROSS-REFERENCES TO RELATED APPLICATIONS

Not Applicable.

STATEMENT REGARDING FEDERALLY SPONSORED RESEARCH

Not Applicable.

BACKGROUND OF THE INVENTION

1. Field of the Invention

The present invention relates to a method for rounding and flattening hollow cylindrical parts which are out of round or are not flat due to non-uniform internal stresses.

2. Description of the Related Art

It is well known that steel parts can distort after heat treatment due to internal stresses created in the part during the heat-treat process. For instance, when a carbon steel part is quenched from above the austenitizing temperature, martensite is formed. The transformation of austenite to martensite is accompanied by an expansion in volume. As a result of the volume expansion, internal stresses are induced into the part. Any irregularities in the internal stresses can cause part distortion. In hollow cylindrical steel parts, the distortion can cause the parts to go out-of-round or cause the parts to lose flatness similar to a potato chip. The distortion is either tolerated in the application for the part or commonly the distortion is honed or ground out of the part at great expense. Thus, there is a need for a more cost effective method for rounding and flattening hollow cylindrical parts which are out of round and/or are not flat.

Methods have been proposed for straightening truck structural members. Methods have also been proposed for straightening out of true shafts. Prior methods have been used where bent heat-treated shafts are straightened by back-bending. Methods for truing out bent shafts have been used wherein forces are applied to a bent shaft in a locally limited area, whereby these forces are sufficient to locally strengthen the shaft to cause compressive residual stress in a surface layer zone of the shaft for reducing the out of true bending of the shaft.

The compressive residual stress may be generated in the surface layer zone of the bent shaft in various manners. Examples of means that have been known for achieving compressive residual stress in a surface layer zone include case hardening, induction hardening, laser beam hardening, nitridation, and deep rolling. The compressive residual stresses are induced only in a surface layer zone of the shaft such that the induced compressive residual stresses cause a corresponding deformation of the shaft. The direction of this deformation depends on which specific surface areas of the shaft have induced compressive residual stresses. It is reported that in order to achieve a desired truing effect, the compressive residual stresses should be induced in the shaft in a defined locally bounded area. This may be achieved by means of a locally limited hardening process, or by means of a locally limited deep rolling operation.

Case hardening in known methods required selective masking of the shaft to prevent surface portions of the shaft which must remain non-hardened from becoming hardened in the case hardening process. The case hardening method of hardening is both energy and labor intensive, and is therefore quite expensive. Nitridation suffers from similar drawbacks. In induction hardening, the shaft to be hardened is placed inside a coil through which a rapidly alternating current is flowing. In this method, it may also be difficult to prevent surface portions of the shaft which must remain non-hardened from becoming hardened in the induction hardening process. As such, induction hardening is also expensive and time-consuming. Deep rolling operations require complicated equipment and therefore, are also quite expensive.

Therefore, while methods have been proposed for straightening out of true shafts, there exists a need for more cost effective methods for rounding and flattening hollow cylindrical parts which are out of round and/or are not flat.

SUMMARY OF THE INVENTION

The present invention meets the foregoing needs by providing a method for rounding and/or flattening an annular part that is out of round and/or not flat due to non-uniform internal stresses typically caused by heat treatment. In the method, the annular part is rounded or flattened by introducing compressive stresses into selected areas on the lower surface, the inside diameter, or the outside diameter of the annular part such that the introduced compressive stresses cause deformation of the annular part thereby rounding and/or flattening the annular part.

In one aspect, the invention provides a method for rounding an annular part having an axis and having an inside surface and an outside surface wherein the part is out of round due to non-uniform internal stresses typically caused by heat treatment. In this method, it is first determined where the annular part is out of round. This can be done by measuring distances along reference lines from the axis of the annular part to corresponding sections of the outside surface of the annular part associated with each reference line. The annular part will be most out of round at a section of the outside surface furthest from the axis. Therefore, the method includes the step of identifying a first section of the outside surface of the annular part that is a greater distance from the axis than a second section of the outside surface. Compressive stresses are then introduced into a surface section of the inside surface that is opposite the first section of the outside surface, whereby the introduced compressive stresses cause deformation of the annular part thereby rounding the annular part. The compressive stresses may be introduced into the selected sections of the annular part using laser heating, laser heating and quenching, laser shock peening, and shot peening methods. Preferably, each cross section in a part processed according to this aspect of the invention has balanced stress symmetric about the centroid such that the part will be round.

In another aspect, the invention provides a method for rounding an annular part having an axis and having an inside surface and an outside surface wherein the part is out of round due to non-uniform internal stresses typically caused by heat treatment. In this method, it is first determined where the annular part is out of round. This can be done by measuring distances along reference lines from the axis of the annular part to corresponding sections of the outside surface of the annular part associated with each reference line. The annular part will be most out of round at a section of the outside surface furthest from the axis. Therefore, the method includes the step of identifying a first section of the outside surface of the annular part that is a greater distance from the axis than a second section of the outside surface. Compressive stresses are then introduced into at least one surface section of the outside surface other than the first section of the outside surface, whereby the introduced compressive stresses cause deformation of the annular part thereby rounding the annular part. The compressive stresses may be introduced into the selected sections of the annular part using laser heating, laser heating and quenching, laser shock peening, and shot peening methods. Preferably, each cross section in an annular part processed according to this aspect of the invention has the same internal stress distribution around the part such that the part will be round.

In yet another aspect, the invention provides a method for flattening an annular part having an axis and a reference plane normal to the axis and having a first end surface and a second end surface wherein all points on the first end surface are not equidistant from the reference plane due to non-uniform internal stresses typically caused by heat treatment. In this method, it is first determined where the annular part is not flat. This can be done by measuring distances along normal reference lines from the reference plane to surface sections of the first end surface associated with each normal reference line. The part will be most out of flat at a section of the first end surface furthest from the lower reference plane. Therefore, the method includes the step of identifying a first surface section of the first end surface that is a greater distance from the reference plane than a second section of the first end surface. Compressive stresses are then introduced into a surface section of the second end surface opposite the first surface section of the first end surface whereby the introduced compressive stresses cause deformation of the annular part thereby flattening the annular part. The compressive stresses may be introduced into the selected sections of the annular part using laser heating, laser heating and quenching, laser shock peening, and shot peening methods. Preferably, each cross section in an annular part processed according to this aspect of the invention has the same internal stress distribution around the part such that the part will be flat.

In still another aspect, the invention provides a method for rounding an annular part having an axis and having an inside surface and an outside surface wherein the part is out of round due to non-uniform internal stresses typically caused by heat treatment. In this method, it is first determined where the annular part is out of round. This can be done by measuring distances along reference lines from the axis of the annular part to corresponding sections of the outside surface of the annular part associated with each reference line. The annular part will be most out of round at a section of the outside surface furthest from the axis. Therefore, the method includes the step of identifying a first section of the outside surface of the annular part that is a greater distance from the axis than a second section of the outside surface. Compressive stresses are then relieved in the first surface section of the outside surface, whereby relieving the compressive stresses causes deformation of the annular part thereby rounding the annular part. The compressive stresses may be relieved by laser tempering the first surface section of the outside surface.

In yet another aspect, the invention provides a method for flattening an annular part having an axis and a reference plane normal to the axis and having a first end surface and a second end surface wherein all points on the first end surface are not equidistant from the reference plane due to non-uniform internal stresses typically caused by heat treatment. In this method, it is first determined where the annular part is not flat. This can be done by measuring distances along normal reference lines from the reference plane to surface sections of the first end surface associated with each normal reference line. The part will be most out of flat at a section of the first end surface furthest from the lower reference plane. Therefore, the method includes the step of identifying a first surface section of the first end surface that is a greater distance from the reference plane than a second section of the first end surface. Compressive stresses are then relieved in the first surface section of the first end surface, whereby relieving the compressive stresses causes deformation of the annular part thereby flattening the annular part. The compressive stresses may be relieved by laser tempering the first surface section of the first end surface.

It is therefore one advantage of the invention to provide a method for rounding an annular part that is out of round due to non-uniform internal stresses wherein compressive stresses are introduced into a surface section of the inside surface of the annular part opposite a section of the outside surface of the annular part that has internal stresses typically caused by the heat treatment.

It is another advantage of the invention to provide a method for rounding an annular part that is out of round due to non-uniform internal stresses wherein compressive stresses are introduced into at least one surface section of the outside surface of the annular part other than a first section of the outside surface of the annular part that has internal stresses typically caused by the heat treatment.

It is yet another advantage of the invention to provide a method for flattening an annular part that is not flat due to non-uniform internal stresses wherein compressive stresses are introduced into a surface section of the second end surface of the annular part opposite a section of the first end surface of the annular part that has internal stresses typically caused by the heat treatment.

It is still another advantage of the invention to provide a method for rounding an annular part that is out of round due to non-uniform internal stresses wherein compressive stresses are relieved by tempering a first section of the outside surface of the annular part that has internal stresses.

It is yet another advantage of the invention to provide a method for flattening an annular part that is not flat due to non-uniform internal stresses wherein compressive stresses are relieved by tempering a surface section of an end surface of the annular part that has internal stresses.

These and other features, aspects, and advantages of the present invention will become better understood upon consideration of the following detailed description, drawings, and appended claims.

DETAILED DESCRIPTION OF THE INVENTION

There are many different ways of heat-treating metallic parts, and heat-treating processes can cause internal stresses in metallic annular parts. For example, in one steel heat-treating process, a carbon steel part is heated above the austenitizing temperature at which the ferrite transforms into austenite, and the part is rapidly quenched such that harder martensite is formed. In quenching, the face centered cubic austenite spontaneously changes to body centered martensite which results in an increase in the volume of the part. As a result of the volume change, internal stresses are induced into the part. Any irregularities in the martensitic volume change results in irregularities in internal stress that can cause part distortion. For instance, in hollow cylindrical steel parts, the distortion can cause the parts to go out-of-round or cause the parts to lose flatness similar to a potato chip.

Carbon steel annular parts may be thru hardened, or may be surface hardened, as in case hardening where carbon is allowed to diffuse into surface sections of a steel part and the steel part is heated and quenched to form a surface layer of hard martensite. Also, carbon steel annular parts may be locally hardened in certain areas like the inside diameter or outside diameter using, for example, case hardening masking techniques or a laser. Any irregularities in the martensitic volume change in thru hardening, surface hardening or local hardening results in irregularities in internal stress that can cause part distortion.

In the present invention, after an annular part is heat-treated (and possibly tempered at a low temperature), the part is checked for out of round and/or out of flat conditions due to non-uniform internal stresses typically caused by the heat treatment. Out of round parts are then rounded by introducing compressive stresses into selected surface sections of the part whereby the introduced compressive stresses cause deformation of the annular part thereby rounding the annular part. Alternatively, out of round parts are rounded by relieving compressive stresses in selected surface sections of the part whereby the relieving of compressive stresses causes deformation of the annular part thereby rounding the annular part. Out of flat parts are flattened by introducing compressive stresses into selected surface sections of the part whereby the introduced compressive stresses cause deformation of the annular part thereby flattening the annular part. Alternatively, out of flat parts are rounded by relieving compressive stresses in selected end surface sections of the part whereby the relieving of compressive stresses causes deformation of the annular part thereby flattening the annular part. While out of round and/or out of flat conditions due to non-uniform internal stresses are typically caused by the heat treatment, the invention is not limited to correcting out of round and/or out of flat conditions caused by the heat treatment.

Figure 1:
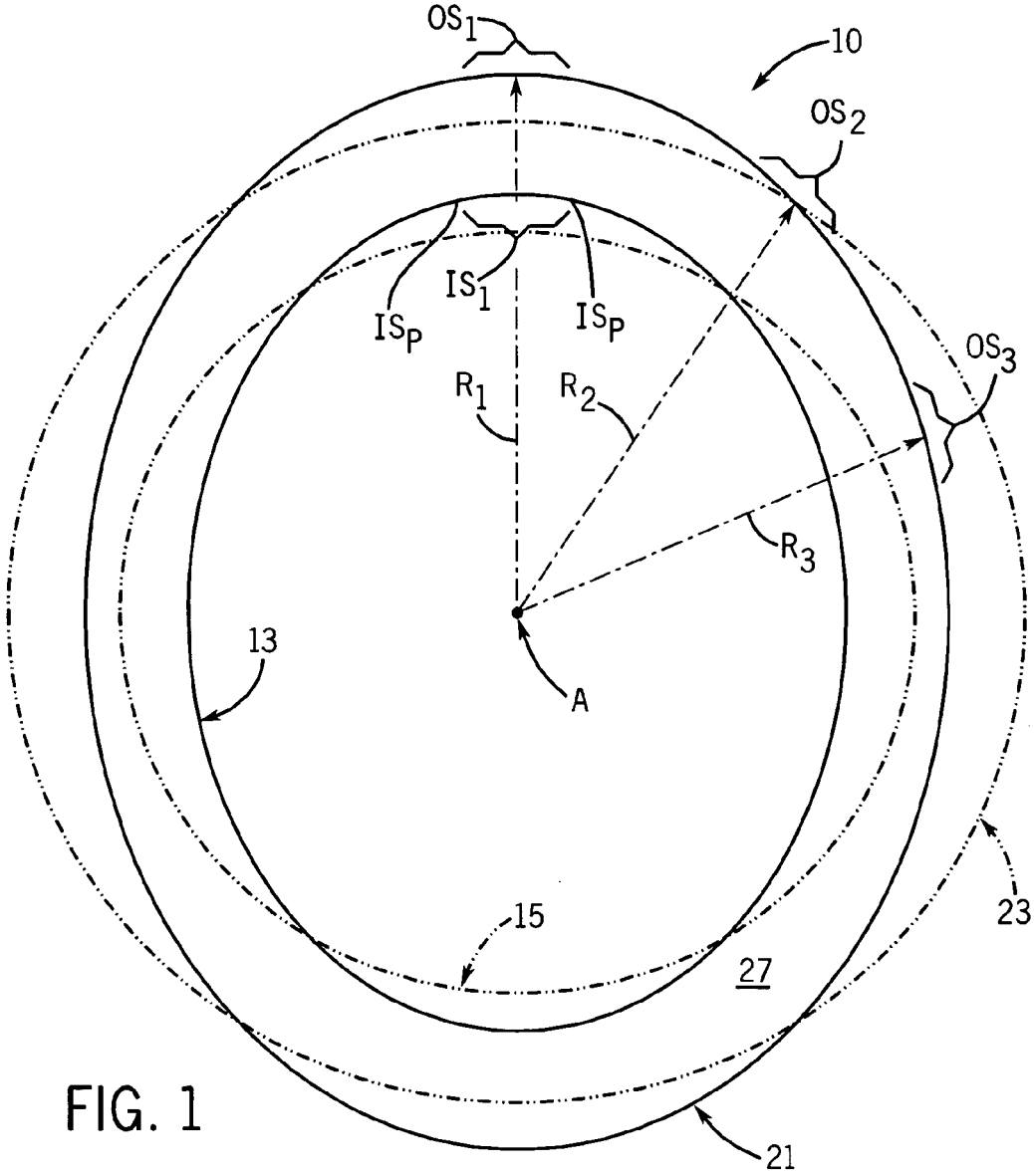
FIG. 1 shows a top plan view of an out of round annular part before processing in accordance with a method of the invention.

Methods according to the invention for rounding an out of round annular part, such as a ring, can be explained with reference to FIG. 1. In FIG. 1, there is shown a top plan view of a heat treated out of round annular part before processing in accordance with a method of the invention. The annular part 10 has an inside surface 13, an outside surface 21, an upper surface 27 and an axis A. Also shown in FIG. 1 are a circular dashed line 15 that represents the inside surface of a perfectly round part and a circular dashed line 23 that represents the outside surface of the same perfectly round part. The perfectly round part has the same axis A as annular part 10. The deviation of the inside surface 13 of the annular part 10 from dashed line 15 and the deviation of the outside surface 21 of the annular part 10 from dashed line 23 shows that annular part is out of round due to non-uniform internal stresses typically caused by the heat treatment.

One method according to the invention for rounding the annular part 10 proceeds as follows. First, distances are measured along reference lines from the axis A of the annular part 10 to sections of the outside surface 21 of the annular part 10 wherein each section of the outside surface 21 is associated with a reference line. These measurements can be made using conventional measuring equipment such as an optical comparator or a vision system. Looking at FIG. 1, imaginary reference lines $R_1$, $R_2$ and $R_3$ are shown that extend from the axis A to corresponding sections $OS_1$, $OS_2$, $OS_3$, of the outside surface 21 respectively. Of course, an infinite number of reference lines are possible that correspond to an infinite number of corresponding sections of the outside surface 21 of the annular part 10. If annular part 10 were perfectly round, imaginary reference lines $R_1$ to $R_n$ corresponding to all sections $OS_1$ to $OS_n$ of the outside surface 21 would be equal. In the method, at least one of the reference lines $R_1$, $R_2$ and $R_3$ should extend beyond the circular dashed line 23 that represents the outside surface of the perfectly round part.

Still referring to FIG. 1, the length of reference lines $R_1$, $R_2$ and $R_3$ is then compared, and the section $OS_1$, $OS_2$, $OS_3$ of the outside surface 21 that most outwardly deviates from perfectly round condition will be the section that corresponds to the longest reference line. For example, in FIG. 1, reference line $R_1$ has the greatest length and therefore, section $OS_1$, of the outside surface 21 deviates most outwardly from perfectly round condition in comparison to sections $OS_2$, $OS_3$ of the outside surface 21. It can be appreciated that if an infinite number of reference lines corresponding to sections of the outside surface 21 of the annular part 10 were used, the imaginary reference line having the longest length would correspond to the section of the outside surface 21 that most outwardly deviates from perfectly round condition.

Because section $OS_1$ of the outside surface 21 deviates more outwardly from perfectly round condition in comparison to sections $OS_2$, $OS_3$ of the outside surface 21, annular part 10 can be rounded by introducing compressive stresses into surface section $IS_1$ of the inside surface 13 shown in FIG. 1. The surface section $IS_1$ of the inside surface 13 has a perimeter $IS_p$ surrounding the intersection of the reference line $R_1$ and the inside surface 13 of the annular part 10 and preferably, compressive stresses are introduced within perimeter $IS_p$ of the inside surface 13. Most preferably, the compressive stresses are introduced into a surface section of the inside surface that is 180 degrees opposite from the section of the outside surface corresponding to the reference line having the longest length.

The compressive stresses are introduced into surface section $IS_1$ of the inside surface 13 so that the internal stress is uniform in the cross section of the annular part 10 between section $OS_1$ of the outside surface 21 and surface section $IS_1$ of the inside surface 13. The introduced compressive stresses in surface section $IS_1$ of the inside surface 13 cause deformation of the annular part thereby rounding the annular part. The rounding magnitude of the annular part 10 is dependent on how strong the introduced compressive stresses are and how deeply the introduced compressive stresses reach into surface section $IS_1$ of the inside surface 13 of the annular part 10. However, in order to achieve a desired rounding effect, the compressive stresses should be introduced into the inside surface 13 of the annular part 10 in a defined locally bounded area. For example, it may be necessary to introduce compressive stresses within 90 degrees of the surface section $IS_1$ of the inside surface 13 of the annular part 10.

The compressive stresses may be introduced into surface section $IS_1$ of the inside surface 13 using different methods. For instance, an industrial laser or similar beam of radiation can be used for rapid heating of the surface section $IS_1$ of the inside surface 13. The laser induces strain into the surface section $IS_1$ of the inside surface 13 by very locally heating the section. The thermal expansion from the heat plastically strains the surface section $IS_1$ resulting in a change in the internal stress distribution.

When the annular part 10 comprises a carbon steel, an industrial laser or similar beam of radiation can be used for rapid heating of the surface section $IS_1$ such that energy transfers from the laser beam to heat energy within the surface section $IS_1$. By using a laser to quickly heat the surface section $IS_1$, the surface section $IS_1$ will self-quench forming martensite, due to the extremely high heat differential between the shallow surface section $IS_1$ heated by the laser and the bulk of the annular part 10. The transformation of austenite to martensite in the surface section $IS_1$ is accompanied by an expansion in volume. As a result of the volume expansion, stresses are induced into the surface section $IS_1$ of the annular part 10 such that the internal stress is uniform in the cross section of the annular part 10 between section $OS_1$ of the outside surface 21 and surface section $IS_1$ of the inside surface 13.

The compressive stresses may be introduced into surface section $IS_1$ of the inside surface 13 using laser shock peening. Multiple radiation pulses from a high power pulsed laser are used to produce shock waves on surface section $IS_1$ of the annular part 10 similar to methods disclosed in U.S. Pat. Nos. 5,131,957, 4,401,477 and 3,850,698. Alternatively, the compressive stresses may be introduced into surface section $IS_1$ of the inside surface 13 using shot peening.

Another method according to the invention for rounding the annular part 10 proceeds as follows. First, distances are measured along reference lines from the axis A of the annular part 10 to sections of the outside surface 21 of the annular part 10 wherein each section of the outside surface 21 is associated with a reference line. These measurements can be made using conventional measuring equipment such as an optical comparator or a vision system. Looking at FIG. 1, imaginary reference lines $R_1$, $R_2$ and $R_3$ are shown that extend from the axis A to corresponding sections $OS_1$, $OS_2$, $OS_3$ of the outside surface 21 respectively. In the method, at least one of the reference lines $R_1$, $R_2$ and $R_3$ should extend beyond the circular dashed line 23 that represents the outside surface of the perfectly round part.

Still referring to FIG. 1, the length of reference lines $R_1$, $R_2$ and $R_3$ is then compared, and the section $OS_1$, $OS_2$, $OS_3$ of the outside surface 21 that most outwardly deviates from perfectly round condition will be the section that corresponds to the longest reference line. For example, in FIG. 1, reference line $R_1$ has the greatest length and therefore, section $OS_1$ of the outside surface 21 deviates most outwardly from perfectly round condition in comparison to sections $OS_2$, $OS_3$ of the outside surface 21.

Because section $OS_1$ of the outside surface 21 deviates more outwardly from perfectly round condition in comparison to sections $OS_2$, $OS_3$ of the outside surface 21, annular part 10 can be rounded by introducing compressive stresses into surface sections of the outside surface 21 other than section $OS_1$ of the outside surface 21. The compressive stresses are introduced into surface sections of the outside surface 21 so that the internal stress is uniform around the outside surface 21 of the annular part 10. The introduced compressive stresses in the surface sections of the outside surface 21 cause deformation of the annular part thereby rounding the annular part. The rounding magnitude of the annular part 10 is dependent on how strong the introduced compressive stresses are and how deeply the introduced compressive stresses reach into surface sections of the outside surface 21 of the annular part 10.

The annular part may be rounded by introducing compressive stresses into at least one surface section of the outside surface other than the section $OS_1$ of the outside surface 21, whereby the introduced compressive stresses cause deformation of the annular part 10 thereby rounding the annular part 10. Preferably, compressive stresses are introduced into each surface section of the outside surface other than the section $OS_1$ of the outside surface 21 so that compressive stresses in surface sections of the outside surface other than the section $OS_1$ of the outside surface 21 are substantially equal to compressive stresses in the section $OS_1$ of the outside surface 21. Most preferably, the compressive stresses are introduced into surface sections of the outside surface other than the section of the outside surface corresponding to the reference line having the longest length.

The compressive stresses may be introduced into surface sections of the outside surface other than the section $OS_1$ of the outside surface 21 using the laser heating, laser heating and quenching, laser shock peening, and shot peening methods described above. When laser hardening occurs, the mass of the part self-quenches the heated area.

Referring still to FIG. 1, when section $OS_1$ of the outside surface 21 deviates more outwardly from perfectly round condition in comparison to sections $OS_2$, $OS_3$ of the outside surface 21, annular part 10 can also be rounded by relieving compressive stresses in surface section $OS_1$ of the outside surface 21. The compressive stresses are locally relieved in surface section $OS_1$ of the outside surface 21 so that the internal stress is uniform around the outside surface 21 of the annular part 10. This causes deformation of the annular part thereby rounding the annular part. The compressive stresses may be relieved in surface section $OS_1$ of the outside surface 21 by laser tempering the surface section $OS_1$ of the outside surface 21. Tempering is particularly advantageous in carbon steel parts.

Figure 2:
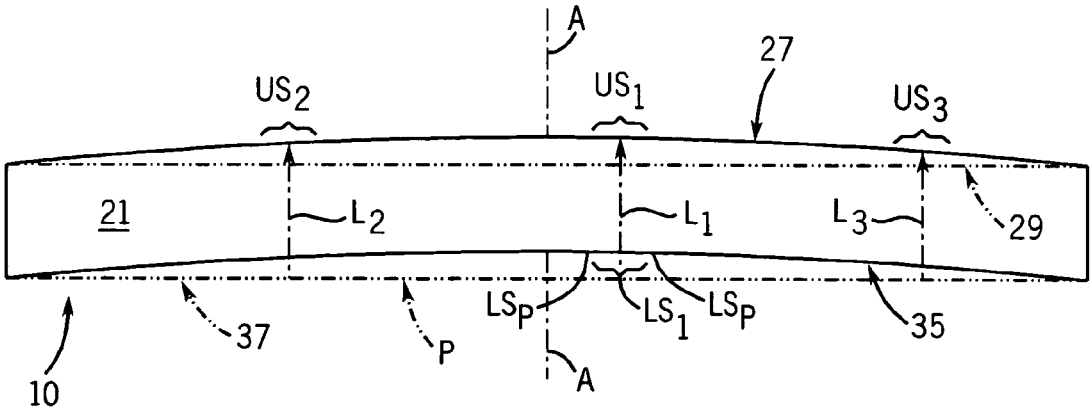
FIG. 2 shows a side elevational view of an annular part that is not flat before processing in accordance with a method of the invention.

Methods according to the invention for flattening an annular part that is not flat can be explained with reference to FIG. 2. In FIG. 2, there is shown a side elevational view of an annular part that is not flat before processing in accordance the invention. The annular part 10 has an outside surface 21, an upper surface 27 providing a first end surface, a lower surface 35 providing a second end surface, and an axis A. Also shown in FIG. 2 are a perfectly flat dashed line 29 that represents the upper surface of a perfectly flat part and a perfectly flat dashed line 37 that represents the lower surface of the same perfectly flat part. The lower surface of the perfectly flat part defines a lower reference plane for the annular part 10. The deviation of the upper surface 27 of the annular part 10 from dashed line 29 and the deviation of the lower surface 35 of the annular part 10 from dashed line 37 shows that annular part is not flat due to non-uniform internal stresses typically caused by the heat treatment.

This method according to the invention for flattening the annular part 10 proceeds as follows. First, distances are measured along reference lines from the dashed line 37 that defines the lower reference plane of the annular part 10 to surface sections of the upper surface 27 of the annular part 10 wherein each section of the upper surface 27 is associated with a reference line. These measurements can be made using conventional measuring equipment such as an optical comparator or a vision system. Looking at FIG. 2, imaginary reference lines $L_1$, $L_2$ and $L_3$ are shown that extend normally from the dashed line 37 that defines the lower reference plane to corresponding sections $US_1$, $US_2$, $US_3$ of the upper surface 27 respectively. Of course, an infinite number of reference lines are possible that correspond to an infinite number of corresponding sections of the upper surface 27 of the annular part 10. If annular part 10 were perfectly flat, imaginary reference lines $L_1$ to $L_n$ corresponding to all sections $US_1$ to $US_n$ of the upper surface 27 would be equal.

Still referring to FIG. 2, the length of reference lines $L_1$, $L_2$ and $L_3$ is then compared, and the section $US_1$, $US_2$, $US_3$ of the upper surface 27 that most upwardly deviates from perfectly flat condition will be the section that corresponds to the longest reference line. For example, in FIG. 2, reference line $L_1$ has the greatest length and therefore, section US, of the upper surface 27 deviates most upwardly from perfectly flat condition in comparison to sections $US_2$, $US_3$ of the upper surface 27. It can be appreciated that if an infinite number of reference lines corresponding to sections of the upper surface 27 of the annular part 10 were used, the imaginary reference line having the longest length would correspond to the section of the upper surface 27 that most upwardly deviates from perfectly flat condition.

Because section $US_1$ of the upper surface 27 deviates more upwardly from perfectly flat condition in comparison to sections $US_2$, $US_3$ of the upper surface 27, annular part 10 can be flattened by introducing compressive stresses into surface section $LS_1$ of the lower surface 35 shown in FIG. 2. The surface section $LS_1$ of the lower surface 35 has a perimeter $LS_p$ surrounding the intersection of the normal reference line $L_1$ and the lower surface 35 of the annular part 10 and preferably, compressive stresses are introduced within perimeter $LS_p$ of the lower surface 35. Most preferably, the compressive stresses are introduced into a surface section of the lower surface that is 180 degrees opposite from the section of the upper surface corresponding to the normal reference line having the longest length.

The compressive stresses are introduced into surface section $LS_1$ of the lower surface 35 so that the internal stress is uniform in the cross section of the annular part 10 between section $US_1$ of the upper surface 27 and surface section $LS_1$ of the lower surface 35. The introduced compressive stresses in surface section $LS_1$ of the lower surface 35 cause deformation of the annular part thereby flattening the annular part 10. The flattening magnitude of the annular part 10 is dependent on how strong the introduced compressive stresses are and how deeply the introduced compressive stresses reach into surface section $LS_1$ of the lower surface 35 of the annular part 10. However, in order to achieve a desired flattening effect, the compressive stresses should be introduced into the lower surface 35 of the annular part 10 in a defined locally bounded area.

The compressive stresses may be introduced into surface sections of the lower surface 35 using the laser heating, laser heating and quenching, laser shock peening, and shot peening methods described above.

Referring still to FIG. 2, when section $US_1$ of the upper surface 27 deviates more upwardly from perfectly flat condition in comparison to sections $US_2$, $US_3$ of the upper surface 27, annular part 10 can be flattened by locally relieving compressive stresses in section $US_1$ of the upper surface 27 shown in FIG. 2. This causes deformation of the annular part thereby flattening the annular part. The compressive stresses may be relieved in section $US_1$ of the upper surface 27 by laser tempering section $US_1$ of the upper surface 27. Tempering is particularly advantageous in carbon steel parts.

It should be appreciated that any combination of the above methods is also within the scope of the invention. Stresses may introduced and/or relieved in any combination of the outside diameter, the inside diameter, the top surface and the bottom surface of the part to change the internal stresses in the part. For example, one could stress relief a surface section of the inside diameter and harden (thereby introducing stresses into) a surface section of the outside diameter to complete the rounding and/or flattening process. Also, the invention is not limited to specific methods for determining flatness or roundness.

EXAMPLES

The following Examples have been presented in order to further illustrate the invention and are not intended to limit the invention in any way.

Example 1

Figure 3:
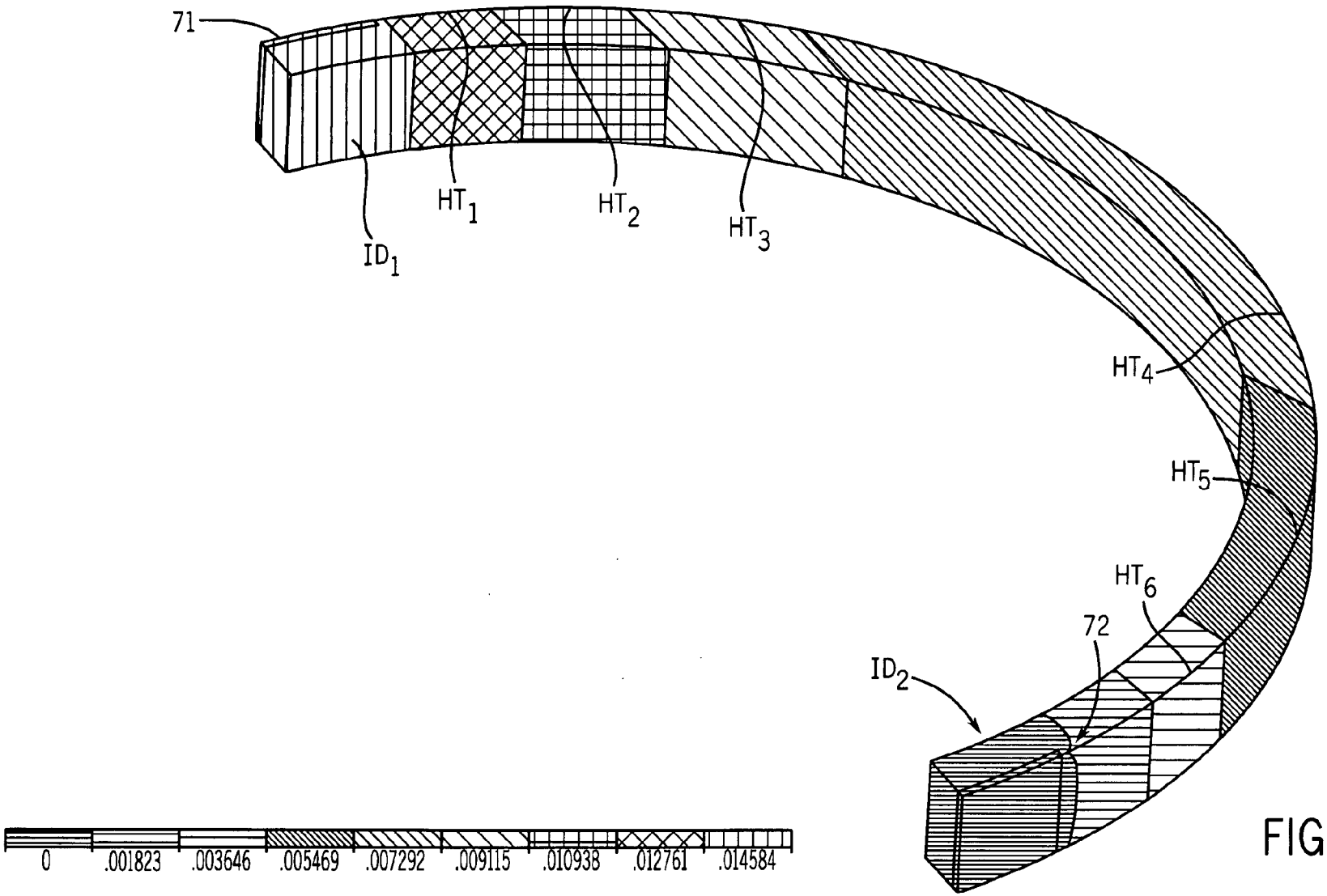
FIG. 3 shows a top perspective view of a half model of a ring gear that is out of round.

Computer modeling was used to show the effects of a surface section volume expansion on the roundness of an annular part. The "Double mark laser shaping" chart shown in FIG. 3 is a half model of a ring gear (teeth not modeled) which is approximately 10 inches in diameter. Small areas 71, 72 on the outside diameter 180 degrees apart were increased in volume by 0.23% to simulate hardening in these local areas. The part went out-of-round by 0.026 inches. This model shows the effect of non-uniform heat-treatment and also that the part could be rounded by further heat-treatment at points $HT_1$, $HT_2$, $HT_3$, $HT_4$, $HT_5$, $HT_6$ around the outside diameter so that the internal stresses would be uniform around the circumference of the part. Alternatively, if the inside diameter were heat-treated in areas $ID_1$ and $ID_2$ corresponding to the area on the outside diameter, the internal stress would be uniform in each cross section around the annular part.

Thus, there are at least two ways to round the annular part as a result of heat-treat distortion. First, if the internal stress distribution in each cross section around the part is the same, then the part will be round. Second, if each cross section in the part has balanced stress symmetric about the centroid, the part will be round. In the invention, one measures the out-of-round to determine where to introduce compressive stresses into the part.

Example 2

Figure 4:
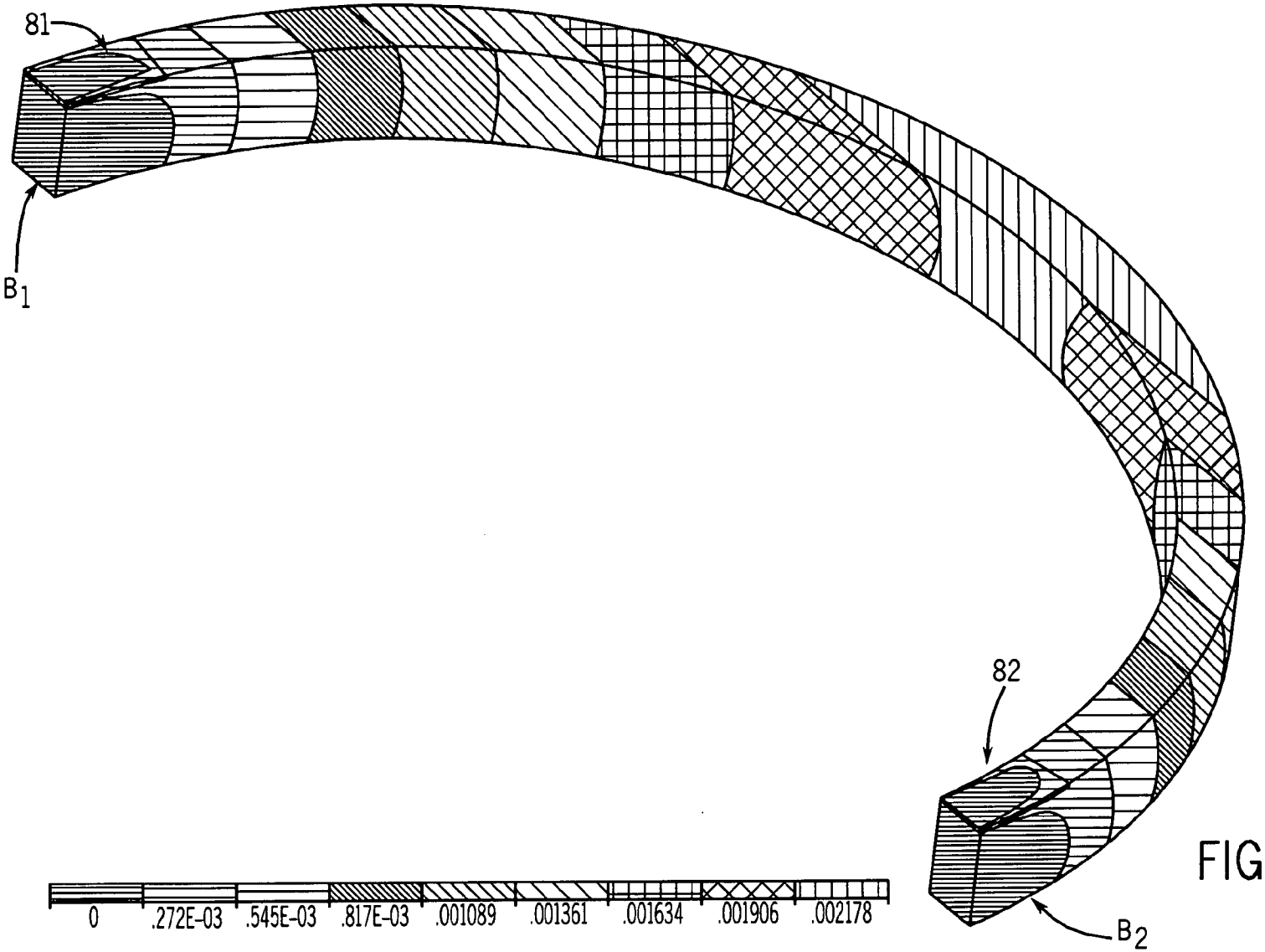
FIG. 4 shows a top perspective view of a half model of a ring gear similar to the ring gear of FIG. 3, wherein the ring gear of FIG. 4 is not flat.

Computer modeling was used to show the effects of a surface section volume expansion on the flatness of an annular part. The "Double mark laser flattening" chart shown in FIG. 4 is a half model of the same ring gear (teeth not modeled) as FIG. 3, which is approximately 10 inches in diameter. Small areas 81, 82 on the top of the gear 180 degrees apart were increased in volume by 0.23% to simulate hardening in these local areas. The part warped 0.0025 inches from flat. Again, this shows the effect of non-uniform heat-treatment and also how by heat-treating the corresponding areas $B_1$, $B_2$ on the bottom of the part, all cross sections of the part would have a uniform stress distribution.

Thus, the invention provides methods for rounding and/or flattening annular parts, such as rings, which are out of round and/or are not flat due to non-uniform internal stresses.

Although the present invention has been described in considerable detail with reference to certain embodiments, one skilled in the art will appreciate that the present invention can be practiced by other than the described embodiments, which have been presented for purposes of illustration and not of limitation. Therefore, the scope of the appended claims should not be limited to the description of the embodiments contained herein.

The invention claimed is:

1. A method for rounding an annular part having an axis and an inside surface and an outside surface wherein the part is out of round due to non-uniform internal stresses, the method comprising:

(a) measuring distances along reference lines from the axis to surface sections of of a reference surface of the annular part, the surface sections being associated with each reference line;

(b) identifying a first surface section of the reference surface having an associated first distance along a first reference line from the axis to the first surface section greater than a second distance along a second reference line from the axis to a surface second section of the reference surface; and (c) introducing compressive stresses into a surface section of the inside surface, the surface section of the inside surface having a perimeter surrounding or adjacent an intersection of the first reference line and the inside surface, whereby the introduced compressive stresses cause deformation of the annular part thereby rounding the annular part, wherein the annular part comprises carbon steel, and wherein step (c) comprises heating to an austenitizing temperature the surface section of the inside surface, and allowing the heated surface section to quench to martensite thereby introducing compressive stresses into the surface section of the inside surface.

2. The method of claim 1 wherein:

step (c) comprises heating to the austenitizing temperature with a beam of radiation.

3. The method of claim 2 wherein:

the beam is a laser beam.

4. A method for rounding an annular part having an axis and having an inside surface and an outside surface wherein the part is out of round due to non-uniform internal stresses, the method comprising:

(a) measuring distances along reference lines from the axis to sections of the outside surface associated with each reference line;

(b) identifying a first section of the outside surface having an associated first distance along a first reference line from the axis to the first section greater than a second distance along a second reference line from the axis to a second section of the outside surface; and (c) introducing compressive stresses into a surface section of the inside surface, the surface section having a perimeter surrounding or adjacent an intersection of the first reference line and the inner surface, whereby the introduced compressive stresses cause deformation of the annular part thereby rounding the annular part, wherein the annular part comprises carbon steel, and wherein step (c) comprises heating to an austenitizing temperature the surface section of the inside surface, and allowing the surface section of the inside surface to quench to martensite thereby introducing compressive stresses into the surface section of the inside surface.

5. The method of claim 4 wherein:

step (c) comprises heating to the austenitizing temperature with a beam of Radiation.

6. The method of claim 5 wherein:

the beam is a laser beam.

7. The method of claim 4 wherein:

the perimeter of the surface section of the inside surface surrounds the intersection of the first reference line and the inner surface.

8. The method of claim 4 wherein:

the perimeter of the surface section of the inside surface is within 90 degrees of the intersection of the first reference line and the inner surface.

9. The method of claim 4 wherein:

the first distance is greater than or equal to all distances measured along reference lines from the axis to sections of the outside surface associated with each reference line.

10. A method for rounding an annular part having an axis and having an inside surface and an outside surface wherein the part is out of round due to non-uniform internal stresses, the method comprising:

(a) measuring distances along reference lines from the axis to surface sections of the outside surface associated with each reference line;

(b) identifying a first surface section of the outside surface having an associated first distance along a first reference line from the axis to the first surface section greater than a second distance along a second reference line from the axis to a surface second section of the outside surface; and (c) introducing compressive stresses into at least one surface section of the outside surface other than the first surface section of the outside surface, whereby the introduced compressive stresses cause deformation of the annular part thereby rounding the annular part, the annular part comprises carbon steel, and step (c) comprises heating to an austenitizing temperature the at least one surface section of the outside surface, and allowing each heated surface section of the outside surface to quench to martensite.

11. The method of claim 10 wherein:

step (c) comprises heating to the austenitizing temperature with a beam of radiation.

12. The method of claim 11 wherein:

the beam is a laser beam.

13. The method of claim 10 wherein:

the first distance is greater than or equal to all distances measured along reference lines from the axis to surface sections of the outside surface associated with each reference line.

14. The method of claim 10 wherein:

step (c) comprises introducing compressive stresses into the surface sections of the outside surface such that compressive stresses in each surface section of the outside surface other than the first section of the outside surface are substantially equal to compressive stresses in the first surface section of the outside surface.

15. A method for flattening an annular part having an axis and a reference plane normal to the axis and having a first end surface and a second end surface wherein all points on the first end surface are not equidistant from the reference plane due to non-uniform internal stresses, the method comprising:

(a) measuring distances along normal reference lines from the reference plane to surface sections of the first end surface associated with each normal reference line;

(b) identifying a first surface section of the first end surface having an associated first distance along a first normal reference line from the reference plane to the first surface section greater than a second distance along a second normal reference line from the reference plane to a second surface section of the first end surface; and (c) introducing compressive stresses into a surface section of the second end surface having a perimeter surrounding or adjacent an intersection of the first normal reference line and the second end surface, whereby the introduced compressive stresses cause deformation of the annular part thereby flattening the annular part, the annular part comprises carbon steel, and step (c) comprises heating to an austenitizing temperature the surface section of the second end surface and allowing the surface section of the second end surface to quench to martensite thereby introducing compressive stresses into the surface section of the second end surface.

16. The method of claim 15 wherein:

step (c) comprises heating to the austenitizing temperature with a beam of radiation.

17. The method of claim 16 wherein:

the beam is a laser beam.

18. The method of claim 15 wherein:

the perimeter of the surface section of the second end surface surrounds the intersection of the first normal reference line and the second end surface.

19. The method of claim 15 wherein:

the first distance is greater than or equal to all distances measured along normal reference lines from the reference plane to surface sections of the first end surface associated with each normal reference line.

20. A method for rounding an annular part having an axis and a surface wherein the part is out of round due to non-uniform internal stresses, the method comprising:

(a) measuring distances along reference lines from the axis to surface sections of the surface, the surface sections being associated with each reference line;

(b) identifying a first surface section of the surface having an associated first distance along a first reference line from the axis to the first surface section greater than a second distance along a second reference line from the axis to a surface second section of the surface; and (c) locally relieving compressive stresses in the first surface section of the surface, whereby relieving the compressive stresses causes deformation of the annular part thereby rounding the annular part.

21. The method of claim 20 wherein:

the annular part comprises carbon steel, and step (c) comprises tempering with a beam of radiation the first surface section of the surface.

22. The method of claim 21 wherein:

the beam is a laser beam.

23. A method for rounding an annular part having an axis and having an inside surface and an outside surface wherein the part is out of round due to non-uniform internal stresses, the method comprising:

(a) measuring distances along reference lines from the axis to sections of the outside surface associated with each reference line;

(b) identifying a first section of the outside surface having an associated first distance along a first reference line from the axis to the first section greater than a second distance along a second reference line from the axis to a second section of the outside surface; and (c) locally relieving compressive stresses in the first surface section of the outside surface whereby relieving the compressive stresses causes deformation of the annular part thereby rounding the annular part.

24. The method of claim 23 wherein:

the annular part comprises carbon steel, and step (c) comprises tempering with a beam of radiation the first surface section of the outside surface.

25. The method of claim 24 wherein:

the beam is a laser beam.

26. A method for flattening an annular part having an axis and a reference plane normal to the axis and having a first end surface and a second end surface wherein all points on the first end surface are not equidistant from the reference plane due to non-uniform internal stresses, the method comprising:

(a) measuring distances along normal reference lines from the reference plane to surface sections of the first end surface associated with each normal reference line;

(b) identifying a first surface section of the first end surface having an associated first distance along a first normal reference line from the reference plane to the first surface section greater than a second distance along a second normal reference line from the reference plane to a second surface section of the first end surface; and (c) locally relieving compressive stresses in first surface section of the first end surface, whereby relieving the compressive stresses causes deformation of the annular part thereby flattening the annular part.

27. The method of claim 26 wherein:

the annular part comprises carbon steel, and step (c) comprises tempering with a beam of radiation the first surface section of the first end surface thereby relieving compressive stresses in the first surface section of the first end surface.

28. The method of claim 27 wherein:

the beam is a laser beam.

* * * * *